US006848383B2

(12) United States Patent
Maeda et al.

(10) Patent No.: US 6,848,383 B2
(45) Date of Patent: Feb. 1, 2005

(54) PERSONAL WATERCRAFT

(75) Inventors: Kiyoaki Maeda, Kobe (JP); Kanji Kiyohara, Akashi (JP); Takeru Oshima, Kobe (JP); Yukio Asakura, Akashi (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/456,666

(22) Filed: Jun. 6, 2003

(65) Prior Publication Data

US 2004/0031427 A1 Feb. 19, 2004

(30) Foreign Application Priority Data

Jun. 17, 2002 (JP) ..... 2002-175436

(51) Int. Cl.[7] ..... B63B 59/02
(52) U.S. Cl. ..... 114/219

(58) Field of Search ..... 114/219, 55.5–55.57

(56) References Cited

U.S. PATENT DOCUMENTS 3,065,724 A * 11/1962 Tritt ..... 114/88
4,004,542 A * 1/1977 Holmes ..... 440/38

* cited by examiner

*Primary Examiner*—Ed Swinehart
(74) *Attorney, Agent, or Firm*—Kolisch Hartwell, P.C.

(57) ABSTRACT

A substantially U-shaped front bumper as seen in a plan view is mounted on a gunnel at a front end of the watercraft so as to partially cover the gunnel. The front bumper has a base portion attached to the gunnel, and an extending portion extending upwardly from the base portion so as to partially cover a streamlined surface of a deck. The base portion is provided with right and left concave portions extending in the lateral direction of the body. The extending portion is provided with a concave portion extending from one end to the other end in the lateral direction.

8 Claims, 7 Drawing Sheets

PERSONAL WATERCRAFT

BACKGROUND OF THE INVENTION

1. Field of the Invention

The present invention relates to a jet-propulsion personal watercraft (PWC) which ejects water rearward and planes on a water surface as the resulting reaction. More particularly, the present invention relates to a personal watercraft provided with a front bumper that covers a front end portion of a body of the watercraft.

2. Description of the Related Art

In recent years, jet-propulsion personal watercraft have been widely used in leisure, sport, rescue activities, and the like.

In general, the personal watercraft comprises a body having a hull forming a bottom and a deck provided over the hull. The personal watercraft is configured to have a water jet pump that pressurizes and accelerates water sucked from a water intake generally provided on a hull bottom surface and ejects it rearward from an outlet port. As the resulting reaction, the personal watercraft is propelled forward.

A joint portion of the hull and the deck which is formed over the entire periphery of the body is called a gunnel. A buffer member such as a front bumper or a rear bumper is mounted on the gunnel. The buffer member substantially protects the body of the watercraft from wear caused by contact with a pier or another watercraft at rest on the water, when the watercraft is beached.

During cruising, a front end portion of the body of the watercraft, which is located on a "fore" side of the watercraft, frequently makes contact with the water. More often than not, unwanted objects such as wood pieces are floating on the water. Therefore, it is necessary to protect the body of the watercraft from impact generated by contact with the objects floating on the water.

In the personal watercraft equipped with a fuel tank in a front portion inside the body, an oil inlet is provided in the vicinity of the front end portion of the body, and a synthetic-resin cover is attached to cover the oil inlet for improved external appearance. Therefore, during cruising, it is necessary to protect the cover from the impact generated by contact with the objects flowing on the water. Further, a fluid resistance generated by the water coming from the front directly to the front end portion of the body has been problematic.

SUMMARY OF THE INVENTION

The present invention addresses the above-described condition, and an object of the present invention is to provide a watercraft that can protect a front end portion of a body during cruising.

According to the present invention, there is provided a jet-propulsion personal watercraft, comprising: a body having a hull and a deck; a water jet pump mounted in the body, for ejecting water rearward to propel the watercraft as a reaction of the ejecting water; and a buffer member mounted on a joint portion where the hull and the deck are joined to each other so as to cover a front end portion of the body, wherein the body has a streamlined surface and the buffer member has a base portion that covers the joint portion and an extending portion extending upwardly from the base portion so as to partially cover the streamlined surface of the body.

The buffer member can protect the gunnel and the front end portion of the body that makes contact with objects floating on the water during cruising.

In the personal watercraft, the extending portion may extend upwardly from the base portion with a height increasing from a front end of the body toward a lateral end of the extending portion.

In the personal watercraft, the buffer member has a concave portion on a front surface thereof, extending in a lateral direction of the body. In this structure, the water, which makes contact with the buffer member provided on the front end portion of the body, is smoothly guided toward the lateral end of the buffer member along the concave portion. Therefore, the front end portion of the body is protected and a fluid resistance generated by the water coming from the front directly to the buffer member provided on the front end portion of the body is reduced.

In the personal watercraft, the concave portion may be provided in each of the base portion and the extending portion. In this structure, the fluid resistance generated by the water coming from the front directly to the buffer member provided on the front end portion of the watercraft is reduced effectively.

In the personal watercraft, the concave portion may have a substantially U-shaped cross-section when sectioned along a direction perpendicular to a longitudinal direction of the concave portion. In this structure, the water that makes contact with the buffer member provided on the front end portion of the body is smoothly guided toward the lateral end of the buffer member along the concave portion.

In the personal watercraft, the concave portion may have a depth that increases from the vicinity of the front end of the watercraft toward the lateral end of the buffer member. Also, the concave portion may have a width that increases from the vicinity of the front end of the watercraft toward the lateral end of the buffer member.

In this structure, since the buffer member is streamlined, i.e., an area of a shadow formed by projecting light from the front toward the buffer member is made smaller than that of the conventional buffer member, a contact area of the front end portion of the watercraft exposed to the water is reduced. Further, during cruising, the fluid resistance generated by the water coming from the front directly to the buffer member provided on the front end portion of the body is reduced.

According to the present invention, there is provided a jet-propulsion personal watercraft, comprising: a body having a hull and a deck; a water jet pump mounted in the body, for ejecting water rearward to propel the watercraft as a reaction of the ejecting water; and a buffer member mounted on a joint portion where the hull and the deck are joined to each other so as to cover a front end portion of the body, wherein the buffer member has a step portion on a front surface thereof, extending in a lateral direction of the body in order to control water flow.

With this structure, the water that makes contact with the buffer member provided on the front end portion of the body is smoothly guided toward the lateral end of the watercraft along the step portion.

The above and further objects and features of the invention will more fully be apparent from the following detailed description with the accompanying drawings.

DETAILED DESCRIPTION OF THE PREFERRED EMBODIMENT

Hereinafter, an embodiment of a personal watercraft of the present invention and the associated engine will be described with reference to the accompanying drawings.

Figure 1:
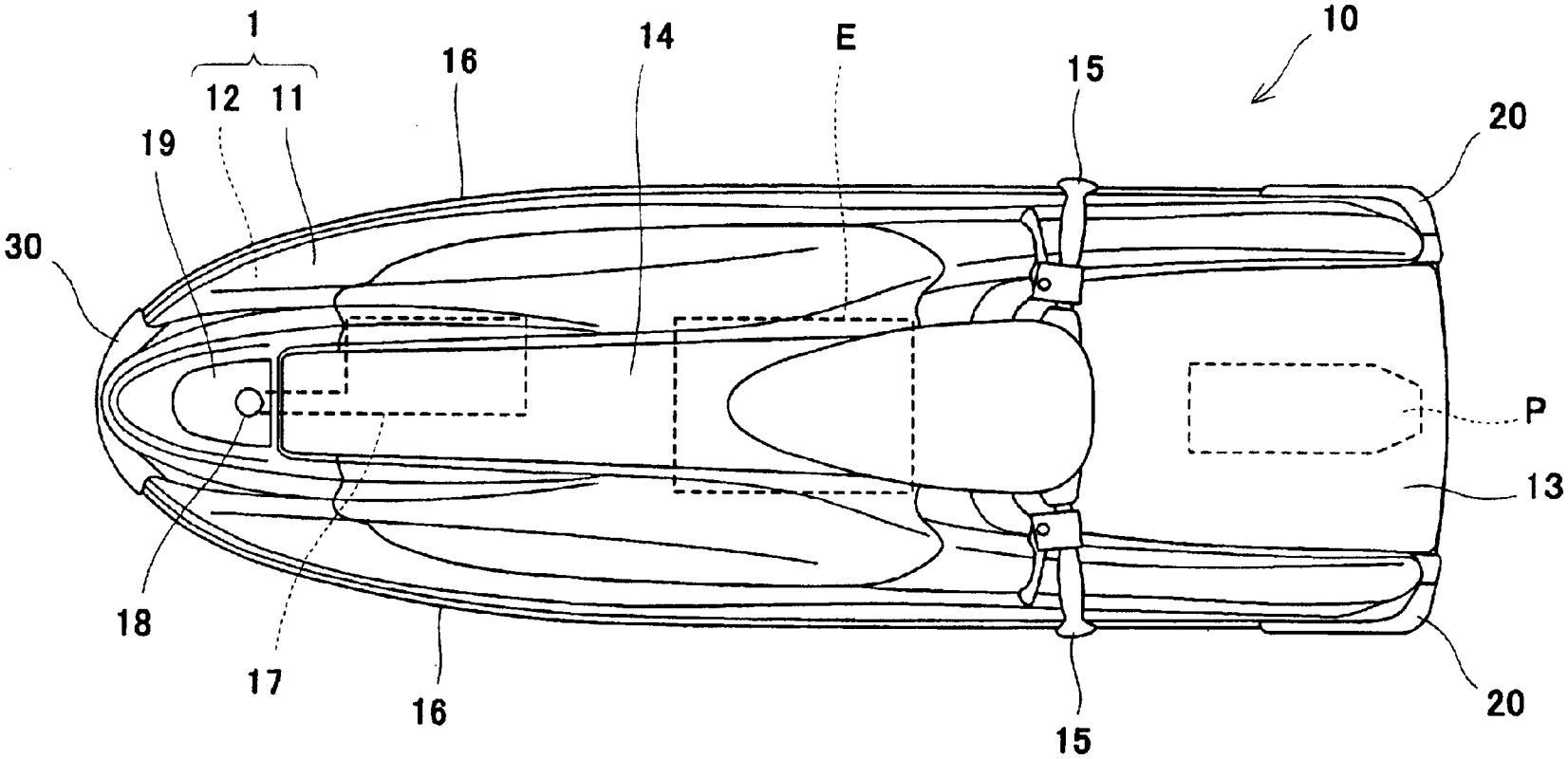
FIG. 1 is a plan view of a personal watercraft according to an embodiment of the present invention.
Figure 2:
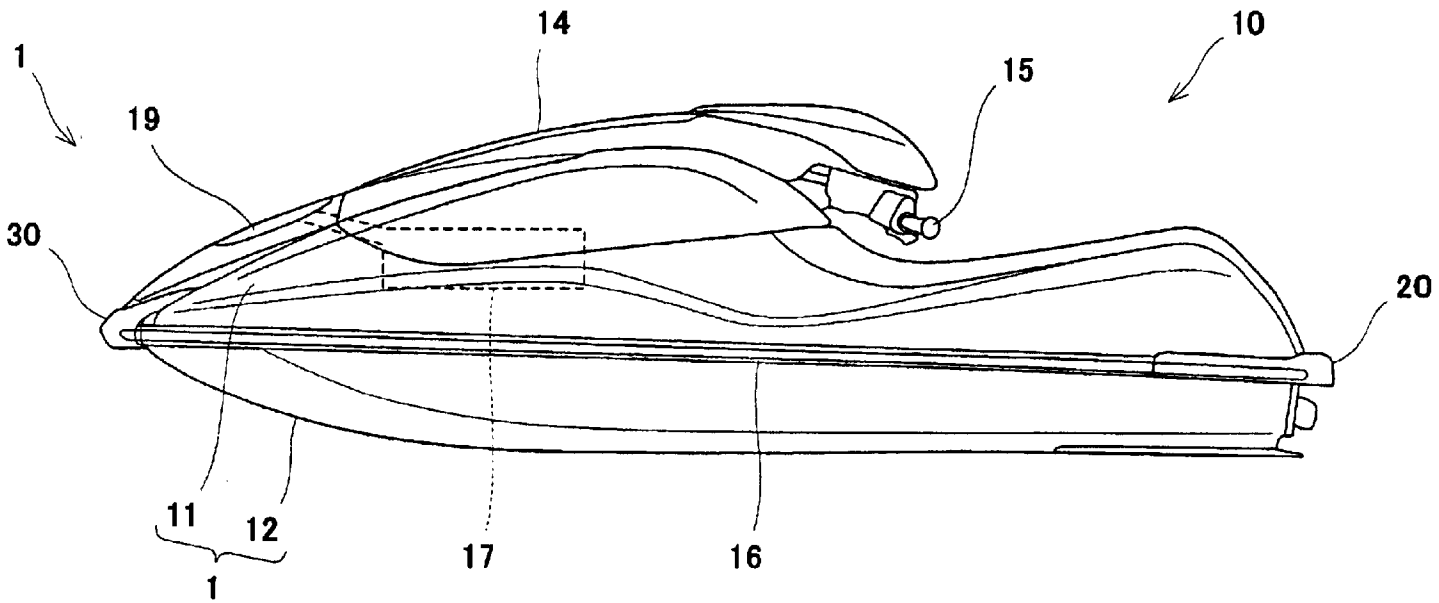
FIG. 2 is a side view of the personal watercraft in FIG. 1.

Referring to FIGS. 1 and 2, a body 1 of a watercraft 10 has a floating structure having an inner space obtained by joining edge portions of a deck 11 and a hull 12. The deck 11 is an upper member and the hull 12 is a lower member forming a bottom. The deck 11 and the hull 12 are laterally symmetric with respect to a longitudinal axis (axis extending from a fore to an aft) of the body 1 as seen from a plan view. The deck 11 and the hull 12 have substantially pointed front portions to obtain a streamlined surface of the body 1.

The deck 11 is provided with a floor 13 at a rear portion thereof on which a rider rides in a standing or kneeling position. A front end of a steering column 14 having a steering handle 15 at a rear end thereof is pivotally mounted on a front portion of the deck 11. The steering column 14 is vertically pivotable around its front end.

As shown in FIG. 1, an engine E is mounted substantially at the center inside the body 1 of the personal watercraft 10, and a water jet pump P is mounted at a rear portion (on the aft side) of the body and driven by the engine E. A fuel tank 17 is provided at the front portion (on the fore side) inside the body 1. An inlet 18 is provided in the vicinity of the front end of the deck 11 (in the vicinity of the fore). From the inlet 18, a fuel is fed into the fuel tank 17. A cover 19 made of synthetic resin is provided over the inlet 18.

In the personal watercraft 10, the rider grips the steering handle 15 and rides on the floor 13. The engine E drives the water jet pump P, which pressurizes and accelerates water and ejects the water rearward and, as the resulting reaction, the watercraft 10 is propelled.

A joint portion 16 of the deck 11 and the hull 12, which is formed over the periphery of the watercraft 10, is called a gunnel. At a front portion of the watercraft 10 on the gunnel 16, a front buffer member (hereinafter referred to as a "front bumper") 30 is mounted to relieve impact generated by contact with other objects. In addition, at the right and left corners of a rear portion of the watercraft 10 on the gunnel 16, corner buffer members (hereinafter referred to as "corner bumpers") 20 are respectively mounted. The front bumper 30 and the corner bumpers 20 are molded from synthetic resin such as polypropylene.

Figure 3:
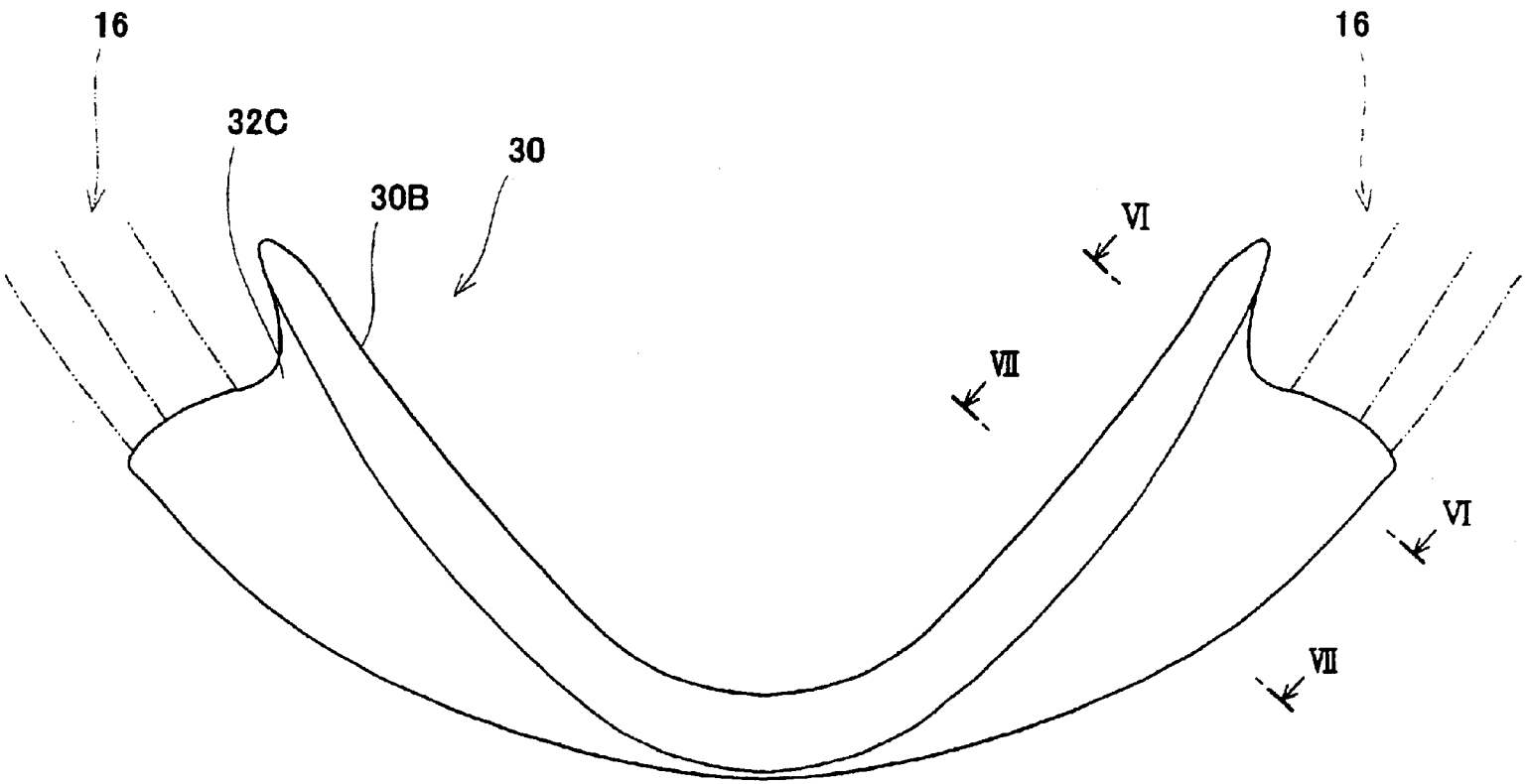
FIG. 3 is a plan view of a front bumper mounted on the personal watercraft in FIG. 1.
Figure 4:
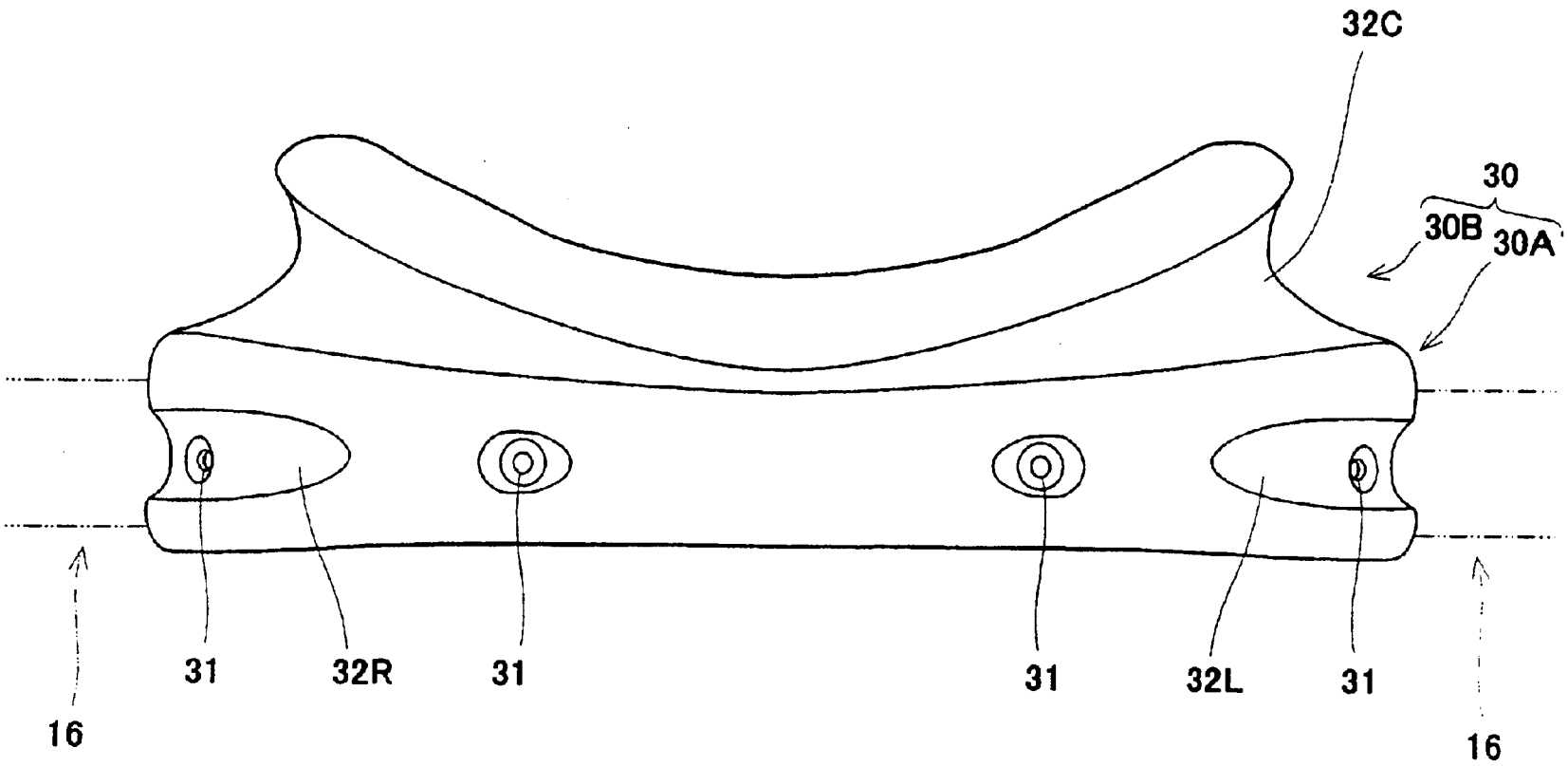
FIG. 4 is a front view of the front bumper mounted on the personal watercraft in FIG. 1.
Figure 5:
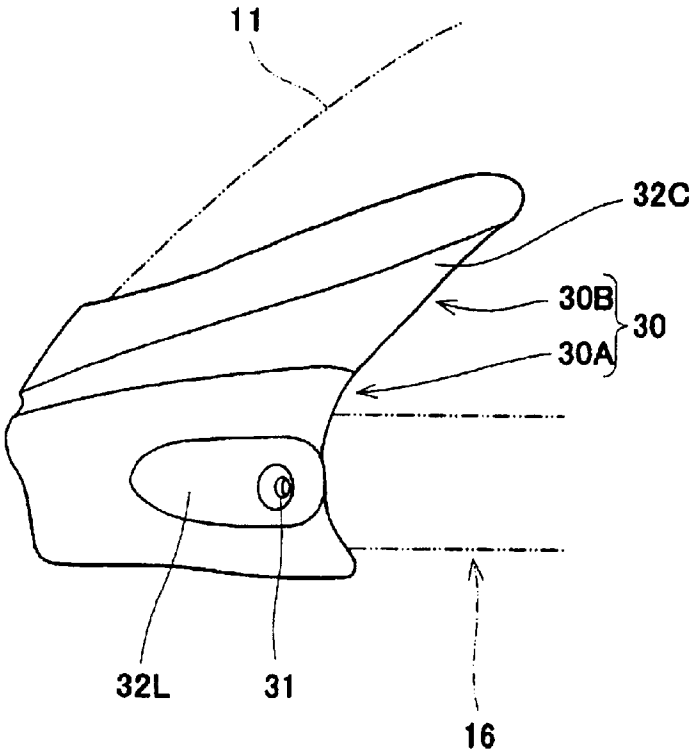
FIG. 5 is a left side view of the front bumper mounted on the personal watercraft in FIG. 1.

As shown in FIG. 3, the front bumper 30 is curved in a substantially U-shape so as to partially cover the gunnel 16 at the front end of the watercraft 10, as seen in a plan view. As shown in FIGS. 4 and 5, the front bumper 30 is fixed to the gunnel 16 by means of a plurality of screws 31.

More specifically, as shown in FIGS. 4 and 5, the front bumper 30 comprises a base portion 30A covering the gunnel 16 at the front end of the watercraft 10, and an extending portion 30B extending upwardly from the base portion 30A so as to partially cover a streamlined surface of deck 11. The base portion 30A is substantially U-shaped. As shown in FIG. 4, the extending portion 30B extends to partially cover the surface of the deck 11 with a height from the gunnel 16 increasing from a front end of the watercraft 10 (longitudinal end of the watercraft 10) toward right and left ends of the extending portion 30B in the lateral direction. The base portion 30A functions similarly to the conventional buffer member except for concave portions 32L and 32R mentioned later. The extending portion 30B serves to protect the vicinity of the front end of the deck 11 from impact generated by contact with the objects floating on the water, during cruising of the watercraft 10.

Figure 6:
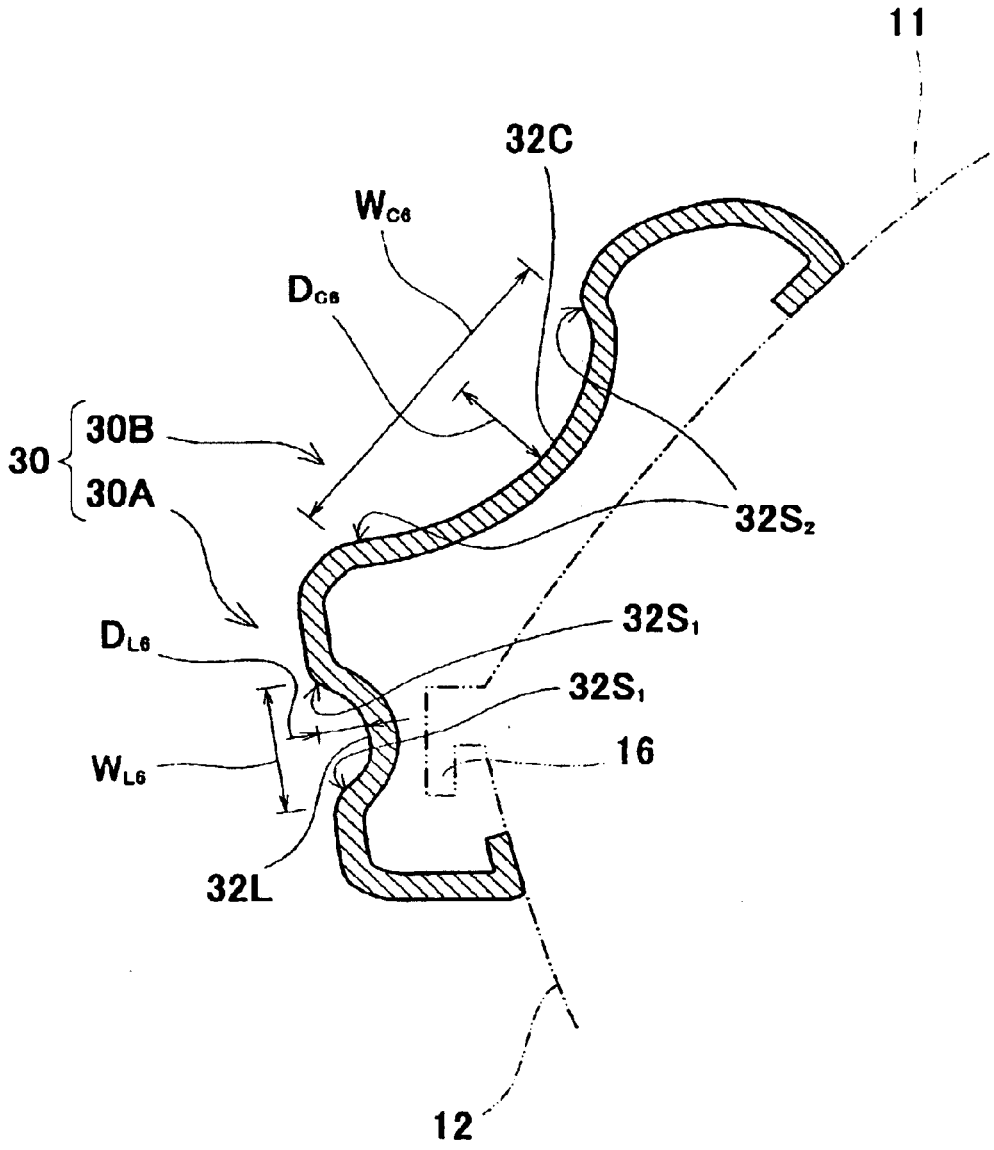
FIG. 6 is a cross-sectional view taken in the direction of arrows along line VI—VI of the front bumper in FIG. 3.

As shown in FIGS. 4 and 5, the base portion 30A and the extending portion 30B are each provided with concave portions. The base portion 30A is provided with right and left concave portions 32R and 32L continuously extending from the vicinity of the front end to right and left ends of the base portion 30A in the lateral direction. The extending portion 30B is provided with a concave portion 32C continuously extending from one end to the other end in the lateral direction. As shown in FIG. 6, the concave portions 32L and 32C have substantially U-shaped cross-sections when sectioned along the direction perpendicular to the longitudinal direction in order to control water flow to be smooth. The concave portion 32L is formed by step portions (step-down portion and step-up portion) 32S1 and the concave portion 32C is formed by step portions 32S2. The concave portion 32R has a shape similar to that of the concave portion 32L.

Figure 7:
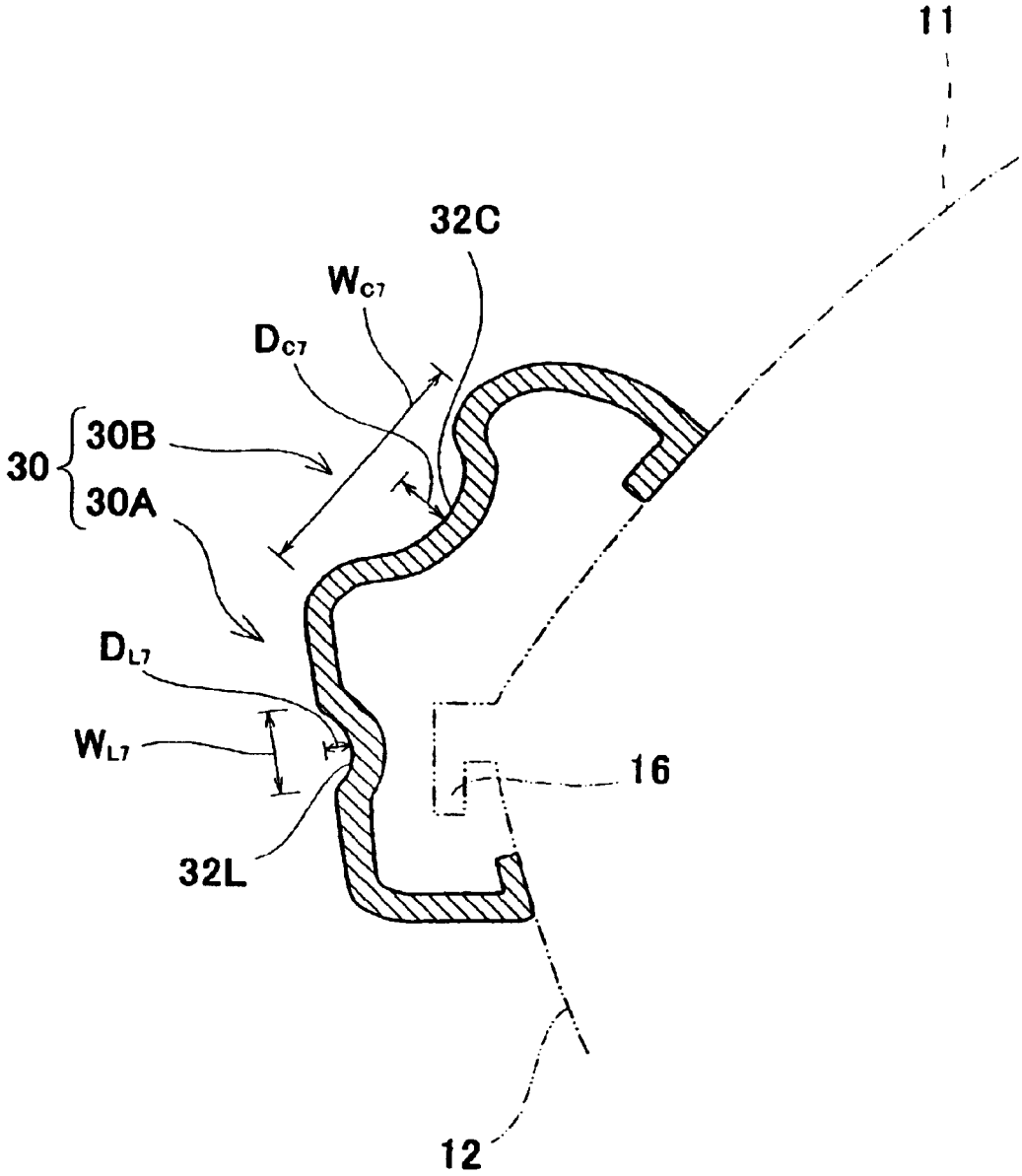
FIG. 7 is a cross-sectional view taken in the direction of arrows along line VII—VII of the front bumper in FIG. 3.

The cross-section of the front bumper 30 in FIG. 7 is sectioned at a location closer to the front end of the body than the cross-section of the front bumper 30 in FIG. 6. As can be seen from FIGS. 4, 6, and 7, the depth of the concave portion 32L and the depth of the concave portion 32C increase from the front end to the lateral end, and the width of the concave portion 32L and the width of the concave portion 32C also increase from the front end to the lateral end. More specifically, the depth DL6 of the concave portion 32L in the cross-section in FIG. 6 is larger than the depth DL7 of the concave portion 32L in the cross-section in FIG. 7 and the depth DC6 of the concave portion 32C in the cross-section in FIG. 6 is larger than the depth DC7 of the concave portion 32C in the cross-section in FIG. 7. And, the width WL6 of the concave portion 32L in the cross-section in FIG. 6 is larger than the width WL7 of the concave portion 32L in the cross-section in FIG. 7 and the width WC6 of the concave portion 32C in the cross-section in FIG. 6 is larger than the width WC7 of the concave portion 32C in the cross-section in FIG. 7. The concave portion 32R has a structure similar to that of the concave portion 32L.

The front bumper 30 having the above structure is streamlined. To be specific, because of the presence of the concave portions 32L and 32R, an area of a shadow formed by projecting light from the front toward the base portion 30A is smaller than that of the conventional front bumper. Therefore, a contact area of the front end portion of the watercraft exposed to the water is reduced and the water that makes contact with the front bumper 30 is smoothly guided toward the lateral ends. In addition, a fluid resistance generated by the water coming from the front directly to the front bumper 30 provided on the front end portion of the body 1 is reduced during cruising.

Since the front bumper 30 has the extending portion 30B, the front end portion of the body is protected. Along the concave portion 32C provided in the extending portion 30B, the water that makes contact with the front bumper 30 provided on the front end portion of the body 1 is smoothly guided toward the lateral ends.

As a matter of course, the front bumper 30 functions as the buffer member as in the conventional front dumper. Instead of the stand-up type watercraft in FIGS. 1 and 2, the present invention is applied to a straddle-type watercraft.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A jet-propulsion personal watercraft, comprising:

a body formed by a hull and a deck covering the bull from above, the body having a gunnel formed by a joint portion joining the hull and the deck over an entire periphery thereof;

a water jet pump mounted in the body, for ejecting water rearward to propel the watercraft as a reaction of the ejecting water; and a buffer member mounted on a front portion of the gunnel so as to cover a front end portion of the body, wherein the buffer member has a base portion that covers the gunnel and an extending portion extending upwardly from the base portion so as to partially cover an upwardly oriented external surface of a front end portion of the deck.

2. The jet-propulsion personal watercraft according to claim 1, wherein the extending portion extends upwardly from the base portion with a height increasing from a front end of the body toward a lateral end of the extending portion.

3. The jet-propulsion personal watercraft according to claim 1, wherein the buffer member has a concave portion on an external surface thereof, the concave portion extending rearward along the body.

4. The jet-propulsion personal watercraft according to claim 3, wherein the concave portion is provided in each of the base portion and the extending portion.

5. The jet-propulsion personal watercraft according to claim 3, wherein the concave portion has a substantially U-shaped cross-section when sectioned along a direction perpendicular to a longitudinal direction of the concave portion.

6. The jet-propulsion personal watercraft according to claim 3, wherein the concave portion has a depth that increases from the vicinity of the front end of the watercraft toward the lateral end of the buffer member.

7. The jet-propulsion personal watercraft according to claim 3, wherein the concave portion has a width that increases from the vicinity of the front end of the watercraft toward a rear end of the buffer member.

8. The jet-propulsion personal watercraft according to claim 3, wherein the concave portion has a step portion on an external surface thereof, the step portion extending rearward along the body in order to control water flow.

* * * * *